US006773451B1

(12) United States Patent
Dussere

(10) Patent No.: US 6,773,451 B1
(45) Date of Patent: Aug. 10, 2004

(54) ERGONOMIC TEAT

(76) Inventor: Louis-Marie Dussere, 328 Rue de Vaugirard, 75015 Paris (FR)

( * ) Notice: Subject to any disclaimer, the term of this patent is extended or adjusted under 35 U.S.C. 154(b) by 0 days.

(21) Appl. No.: 09/937,906

(22) PCT Filed: Apr. 12, 2000

(86) PCT No.: PCT/FR00/00939

§ 371 (c)(1),
(2), (4) Date: Dec. 12, 2001

(87) PCT Pub. No.: WO00/61065

PCT Pub. Date: Oct. 19, 2000

(30) Foreign Application Priority Data

Apr. 14, 1999 (FR) ..... 99 04672

(51) Int. Cl.[7] ..... A61J 17/00
(52) U.S. Cl. ..... 606/235
(58) Field of Search ..... 606/234, 235, 606/236; 215/11.4, 11.5; D24/194, 195, 196

(56) References Cited

U.S. PATENT DOCUMENTS 1,207,120 A * 12/1916 Younker ..... 215/11.1
4,856,663 A 8/1989 Epp
4,986,751 A * 1/1991 Bergersen ..... 433/6
5,334,218 A 8/1994 Johnson
5,814,074 A * 9/1998 Branam ..... 606/234

FOREIGN PATENT DOCUMENTS

EP 0 199 005 A1 10/1986
EP 0 383 315 A1 8/1990
EP 0 383 315 * 8/1990
EP 0 400 217 A1 12/1990

* cited by examiner

*Primary Examiner*—Kevin T. Truong
*Assistant Examiner*—Bradford C Pantuck
(74) *Attorney, Agent, or Firm*—Leydig, Voit & Mayer Ltd.

(57) ABSTRACT

A teat for a baby or a child, the teat comprising a plate on which the dental arches rest and defining a bite plane, said plate being terminated towards the front by a vestibular screen against which at least one of the dental arches comes into abutment in a desired position, said plate being secured to means projecting forwards out from the mouth, the teat having a nipple projecting from the rear of the plate, said nipple being in register with the back portion of the tongue when the teat is in operation in the mouth of the baby or child so as to co-operate with the tongue and the palate and stimulate movement analogous to that of suckling.

16 Claims, 3 Drawing Sheets

ERGONOMIC TEAT

CROSS-REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISC

"Not Applicable"

FIELD OF THE INVENTION

The invention relates in general to teats for babies and children. More precisely, the invention can be implemented:

in a teat for sucking (or pacifier) of the type given to babies or to young children to calm them; or in a teat for a baby's bottle.

BACKGROUND OF THE INVENTION

Pacifiers have been known for a long time that are made out of a material such as rubber, comprising a central nipple for co-operating with the tongue of a child or a baby. Such pacifiers are generally provided with a shield for bearing against the outside surface of the lips, and with a ring handle.

The main function of pacifiers is to distract or pacify the child (hence the word "pacifier"). Improved models of pacifiers also exist enabling an auxiliary function to be performed, such as administering an active ingredient that the child swallows while sucking the nipple of the pacifier.

Although such pacifiers can constitute a relatively effective solution to the immediate problem of a restless child, they can nevertheless have extremely harmful effects on the evolving shape of the child's mouth: a well-known problem in particular lies in the creation of a gap between the upper and lower incisors, since the central nipple constitutes an obstacle to development of the child's incisors.

Pacifiers are also known having a special configuration for limiting the damage that can be caused in the mouths of children by excessive use of a pacifier. Examples of such pacifiers are to be found in the following documents: WO 96/20687 (Alanen and Varrella) and FR 2 705 885 (Pick).

The special means of those pacifiers consist in elements for statically distributing the forces due to suction. It is possible that those pacifiers are less harmful to the mouth of a child than are conventional pacifiers having a central nipple for engaging between the middle portions of the lower and upper dental arches; nevertheless, those pacifiers are no more than an imperfect response to the causes of malformations of the mouth.

One of the major causes of malformations of the mouthparts lies in deficient general operation of the mouth. The most advanced work in neuro-occlusal rehabilitation (NOR) has shown the essential role of stimulating the functioning of the mouth in achieving balanced development of the mouthparts (see in particular the work by Prof. Planas "La réhabilitation neuro-occlusale" [Neuro-occlusal rehabilitation]).

From empirical observations made over a long period of time, it has thus been possible to validate the hypothesis that it is beneficial for harmonious development of dentition, to cause the stomatognathic system to function as much as possible, and to do so from birth.

Unfortunately, modem feeding habits do not encourage stimulation of the stomatognathic system: the pap and soft food given to babies, and the generally soft nature of modem food, stimulate this system only partially and insufficiently.

By way of example, observable consequences include the facial skull not developing sufficiently so that the bottom jaw remains set back too far from the top jaw, or teeth that are insufficiently eroded due to no absence of lateral movements of the jaws and that therefore tend to lead to the jaws locking together due to the teeth of the top jaw jamming mutually with the teeth of the bottom jaw.

Oral appliances such as aligners are known for the purpose of correcting the above-mentioned malformations; A problem associated with such appliances is that they are generally poorly accepted by young children, even though it is recognized that the earlier intervention is carried on the mouthparts, the more it is effective.

To reduce this awkward constraint, "hybrid" devices are known that are presented in the form of a pacifier that reproduces certain characteristics of orthodontic aligners and that are provided with a ring for the child to hold. Examples of such devices are to be found in documents FR 2 595 046 (Giordanno) and EP 0 400 217 (Bergersen).

Nevertheless, those devices are not well accepted by young children since they act solely as a constraint and do not provide the satisfaction associated with sucking, which recalls feeding at the breast.

In any event those devices are no more than an imperfect solution to the above-mentioned problems of malformation since:

firstly the devices are poorly accepted by young children so they can be used only once the child has reached an age at which development has already advanced; the devices are therefore curative rather than preventive, and they do not make it possible to avoid the appearance of malformations;

secondly, such devices are naturally "static", since their function is limited to holding certain organs such as the dental arches in desired positions. Thus, that type of device does not stimulate functioning of the stomatognathic system even though it is mentioned above that such stimulation is an important factor in good development of dentition.

The way such devices have evolved is also described in document U.S. Pat. No. 5,814,074, which discloses a pacifier comprising not only elements for positioning the dental arches, but also an element projecting from the rear of the pacifier in order to co-operate with the tip of the child's tongue.

However that evolution does not provide an adequate solution for stimulating the functioning of the stomatognathic system, insofar as the pacifier of U.S. Pat. No. 5,814,074 does not give rise to functioning of the stomatognathic system in a manner analogous to that achieved by suckling, since it does not interfere with the back of the tongue or with the palate.

Finally, attempts have been made to stimulate functioning of a child's tongue: document EP 0 199 005 (Rodam SA) teaches a pacifier in which the teat is fixed to elastic means so as to reproduce to some extent the way in which the mouth of a child is stimulated by the breast and to encourage horizontal movement of the lower dental arch. However, although such a device can be advantageous in terms of stimulating movements of the mouth, it does not provide any proper positioning of the dental arches.

BRIEF SUMMARY OF THE INVENTION

It can thus be seen that there is a need for teats that can be used by babies and young children, that act simultaneously:

to stimulate functioning of the various portions of the stomatognathic system by giving rise to movements analogous to those performed during chewing or suckling; and to properly position said portions (in particular the two dental arches) relative to one another.

An object of the invention is to satisfy that need.

To achieve this object the invention proposes a teat for a baby or a child, the teat comprising a plate on which the dental arches rest and defining a bite plane, said plate being terminated towards the front by a vestibular screen against which at least one of the dental arches comes into abutment in a desired position, said plate being secured to means projecting forwards out from the mouth, the teat being characterized in that it includes a nipple projecting from the rear of the plate, said nipple being for co-operating with the tongue to stimulate movement analogous to that of suckling.

Preferred but non-limiting aspects of the teat of the invention are as follows:

the projecting nipple is connected to the rear of the plate by elastic means;

the vestibular screen comprises:

a top portion situated above the bite plane; and a bottom portion situated below the bite plane and offset rearwards relative to the top portion;

the offset between the top and bottom portions of the vestibular screen is about 1 millimeters (mm) to 3 mm;

a substantially vertical wall is integrally formed with the rear edge of the plate and co-operates with the vestibular screen to define an aligner for receiving the dental arches;

said plate is generally U-shaped, with limbs extending rearwards to the rear ends of the dental arches;

the plate, the vestibular screen, and the nipple are integrally molded;

the nipple faces the rear portion of the tongue when the teat is in position in the mouth of the baby or the child;

the surface of the plate includes abrasive means;

the means projecting forwards out from the mouth comprise a shield for pressing against the front faces of the lips or a handle ring; and the means projecting forwards out from the mouth comprise an element for closing a baby's bottle, and the teat has a channel passing longitudinally therethrough to enable a baby or a child to suck a liquid contained in the bottle.

BRIEF DESCRIPTION OF THE DRAWINGS

Other aspects, objects, and advantages of the present invention will appear more clearly on reading the following description of a preferred embodiment given with reference to the accompanying drawings, in which.

DETAILED DESCRIPTION OF THE INVENTION

Figure 1:
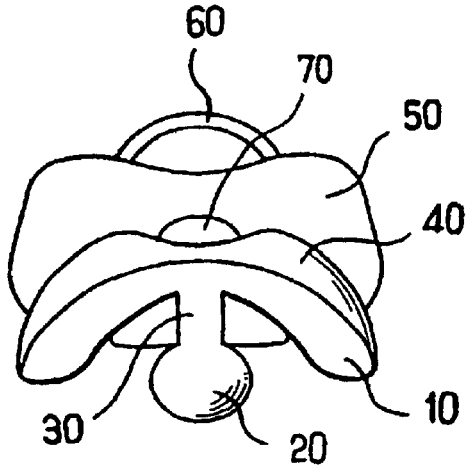
FIG. 1 is a perspective view from behind of a pacifier of the invention.

FIG. 1 shows a pacifier of the invention. This pacifier comprises:

a horizontal plate 10 of generally plane U-shape which is intended to have its concave end pointing towards the front of the mouth, with the ends of the limbs of the U-shape of the plate being directed rearwards. The two main faces of the plate (top face and bottom face) can be made to be slightly abrasive (by using a mold of appropriate surface state or by depositing a suitable surface coating, for example). The plate 10 is intended to receive the two dental arches of the child on its two faces respectively; it thus constitutes a bite plane;

a nipple 20 whose center is situated substantially in the same plane as the plate 10, behind the plate;

an elastic connection portion 30 for connecting the nipple 20 to the back of the plate. The connection between said portion 30 and the plate 10 in the present embodiment is provided in the region of the plate which lies in the middle of the transverse direction of the pacifier;

a wall 40 extending perpendicularly to the plane of the plate from the front edge thereof. This wall is referred herein as a "vestibular screen" and it is intended to ensure that the top dental arch of the baby or child is properly positioned in the plane of the plate 10, with the dental arch that rests on the plate also coming into abutment against the vestibular screen. In the embodiment shown in FIG. 1, the rear edge of the plate 10 does not connect with any wall similar to the vestibular screen 40; and a shield 50 that can be made of a rigid plastics material. This shield is similar to those to be found in conventional pacifiers: it is intended to bear against the outside of the child's lips. The shield 50 is provided on its front face with a handle ring 60 and it is connected to the front of the plate 10 by a second connection portion 70 that is about one centimeter long and that is as thin as possible so as to avoid interfering with closure of the lips (about one millimeter thick, depending on the material used).

Figure 2:
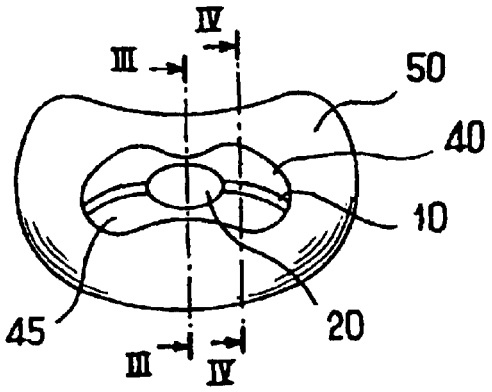
FIG. 2 is an elevation view from behind of the same pacifier, defining longitudinal section planes III—III and IV—IV.

FIG. 2 is a rear elevation of the same pacifier. This figure shows the nipple 20 situated behind the plate 10. This figure also shows the vestibular screen 40 as described above with reference to FIG. 1, which is situated above the plate. The pacifier also has a second vestibular screen 45 which likewise extends in a direction that is substantially perpendicular to the plane of the plate, from the front edge region thereof, and extending below said plate.

Figure 3:
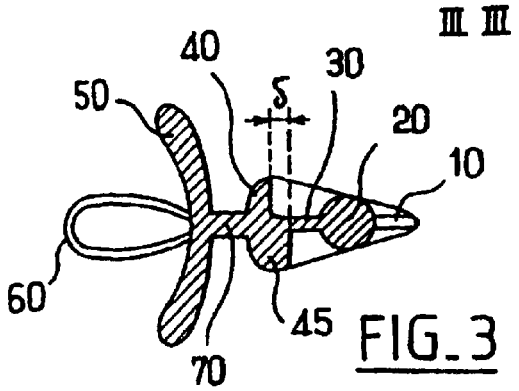
FIG. 3 is a view of the pacifier of FIGS. 1 and 2, shown in section plane III—III.

FIG. 3 is a middle longitudinal section view of the pacifier of FIGS. 1 and 2 and shows in particular the relative positions of the two vestibular screens 40 and 45: in this figure it can be seen that the two screens are situated vertically on opposite sides of the plate 10 but are not in line with each other.

Figure 4:
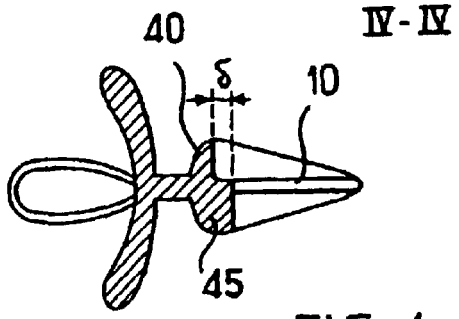
FIG. 4 is a view of the same pacifier shown in section plane IV—IV.

On the contrary, the top screen 40 is advanced a little relative to the bottom screen 45 so as to define an offset δ between the rear faces of the two screens that is about 2 mm. This offset can also be seen in FIG. 4 and is for the purpose of encouraging proper relative positioning of the top and bottom dental arches, the top arch needing to be slightly further forward than the bottom arch so as to enable the teeth of the top arch to overlap the teeth of the bottom arch.

This offset occurs only over the front portions of the vestibular screens 40 and 45, with these screens being extended towards the rear ends of the limbs of the U-shaped plate so that their respective inside faces make contact with the dental arches which extend in register with each other in the vertical direction, such that the offsets established between the top and bottom dental arches relates solely to the longitudinal direction and corresponds to the middle axis of the mouth.

In an embodiment not shown in the figure and intended more particularly for babies and very young children, the vestibular screen 45 extends in register with the screen 40 in a direction perpendicular to the plane of the plate 10.

With children whose teeth have not yet erupted, there is no need to provide an offset δ between the screens 40 and 45; furthermore, eliminating the offset enables the pacifier to be symmetrical about the bite plane of the plate 10, thus avoiding any risk of the pacifier being placed upside-down in the mouth of a young child.

As mentioned above, the plate 10 is intended to receive the top and bottom dental arches of the child on its two faces respectively, and thus defines a bite plane. It must also be as fine as possible so that its thickness does not interfere with closing the mouth. In practice, the thickness of the plate is substantially equivalent to the thickness of the plates of orthodontic aligners, i.e. it is of millimeter order;

By making the faces of the plate 10 abrasive, it is possible to erode the milk teeth of a child if used with a child whose teeth have already appeared. Such erosion encourages lateral movements of the jaws and thus encourages the stomatognathic system to function in full.

Figure 5:
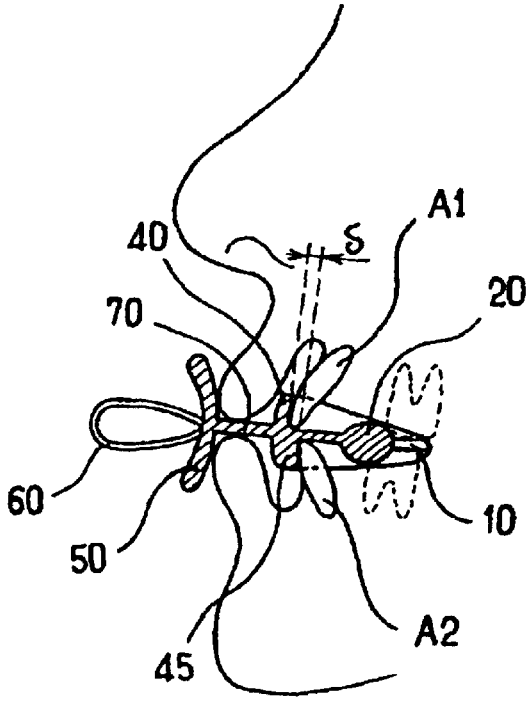
FIG. 5 is a theoretical diagram showing how a pacifier of the invention takes its place in the mouth of a child.

FIG. 5 shows how the pacifier of the invention is positioned in the mouth of a child. In this figure it can be seen that the limbs of the plate 10 extend rearwards as far as the location of the molars, whose positions are identified by dashed lines. This makes it possible to ensure that the faces of the plate co-operate with the entire length of each dental arch.

It can also be seen that the top arch A1 bears against the top of the plate while coming into forward abutment against the rear face of the top vestibular screen 40, while the bottom arch A2 comes into abutment against the bottom vestibular screen 45 which is situated slightly behind the top vestibular screen: the offset δ between the arches A1 and A2 ensures they are properly positioned. As mentioned above, it is also possible with a pacifier for a baby or a very young child to have an offset δ of zero.

The lips of the child come to bear against the respective front faces of the vestibular screens 40 and 45. This contact acts on the lips and reinforces their tone, thereby contributing to overall stimulation of the stomatognathic system.

The connection portion 30 between the plate and the nipple is elastic so as to enable the nipple to move rearwards when pulled by the tongue of the child, while nevertheless continuously urging said nipple towards the plate (forwards).

This elasticity of the connection portion 30 can be obtained by making said portion out of a plastics material that is more elastic than the material used for the plate 10 and the nipple 20, or by designing the shape of this portion in such a manner as to have a narrow section, or indeed by implementing any other known means such as a connection portion 30 capable of moving longitudinally relative to the plate and associated with a spring, as taught by document EP 0 199 005 (Rodam SA).

The elasticity of the connection portion 30 serves to reinforce the child's motivation to interact with the nipple, which then has dynamic behavior similar to that of the breast. The distance between the nipple and the rear of the plate is adapted so that the nipple comes into register with the back of the tongue, thus enabling proper co-operation between the child's tongue and the nipple.

It can thus be seen that the pacifier of the invention performs the following functions simultaneously:

firstly it provides proper relative positioning of the dental arches in the mouth of a baby or a child, by means of the configuration of the plate 10 and of the vestibular screens 40 and 45.

secondly it causes the stomatognathic system to function; unlike conventional oral appliances, this device is not intended to operate statistically. On the contrary, the device of the invention strongly stimulates dynamic functioning of the stomatognathic system; not only must the child move the bottom jaw forwards to position the lower arch A2 beneath the plate 10 and against the lower vestibular screen 45, but also the nipple connected to the pacifier by the elastic connection 30 strongly stimulates the tongue of the child. This second stimulation provides a kind of "motor" causing the child's stomatognathic system to function, with the child finding satisfaction in the process of interaction with the nipple via the tongue and the palate; and finally, pacifiers of the invention act like conventional pacifiers to soothe the child.

In an embodiment not shown in the figures, it is also possible to provide projecting points on the front faces of the vestibular screens 40 and 45 to further reinforce the tone of the lips which press against these front faces.

Figure 6:
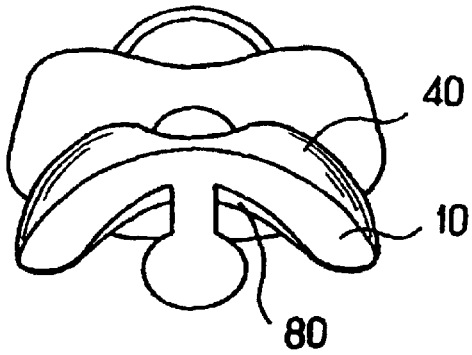
FIG. 6 is a perspective view from behind of a variant embodiment of a pacifier of the invention.

FIG. 6 shows a variant embodiment of the pacifier of the invention, in which the plate 10 is associated not only with a vestibular screen 40 on its front edge, but also with another screen 80, substantially parallel to the screen 40, and extending from the rear edge of the plate. In this variant, an aligner has thus been constituted on the top face of the plate 10 for the purpose of positioning the upper dental arch of the child.

The screen 80 which projects from the rear edge of the plate can project upwards only, as shown in FIG. 6 or it can project from both sides of the plane of the plate so as also to constitute an aligner on the bottom face of the plate in co-operation with the bottom vestibular screen 45.

The pacifiers described can be manufactured using any conventional means: the pacifier can be made by molding a plastics or rubber material to constitute a subassembly comprising the plate 10 and the various screens projecting from its edges, the connection portion 30, and the nipple 20, while the connection portion 70, the shield 50, and the ring 60 can be assembled to the remainder of the pacifier in a subsequent step. It is also possible to envisage molding using a plurality of materials, in which case the elasticity of the material constituting the connection portion 30 can be greater than that of the other molded portions. It is also possible to make the entire pacifier as a single one-piece molding of a single material, with the elasticity of the portion 30 then being obtained by giving said portion a suitable shape (e.g. a narrowing of its section).

Figure 7:
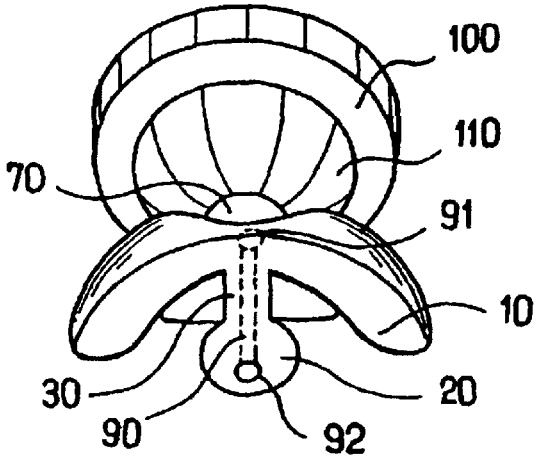
FIG. 7 is a perspective view of a teat of the pacifier for a baby's bottle.

As mentioned above, the invention can also be implemented in a teat for a baby's bottle, as shown in FIG. 7. Under such circumstances, the shield 50 and the handle ring 60 are replaced by a ring 100 for fixing onto a bottle and by a hollow dome 110 integrally molded with the portion 70 connecting with the plate.

The other elements of the teat (plate, screens, nipple) are similar to the elements implemented in the pacifier, except that a longitudinal channel 90 passes right through the plate 10, the connection portion 30, and the nipple 20 so as to connect an orifice 91 opening out into the internal cavity of the dome 110 in register with the bottle to a second orifice 92 that opens out through the surface of the nipple.

In this embodiment as a teat for a baby's bottle, the dental arches of the baby or the child are thus positioned during feeding. All of the variants mentioned above concerning a pacifier are applicable to a teat in accordance with the invention.

Figure 8A:
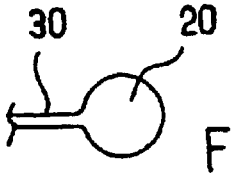
FIGS. 8*a* and 8*b* show two possible shapes for the nipple of a teat of the invention.
Figure 8B:
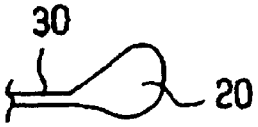

FIGS. 8*a* an 8*b* show two embodiments of the nipple 20. The nipple in FIG. 8*a* is of conventional spherical shape. The nipple of FIG. 8*b* is flattened on top so as to facilitate co-operation between the top of the nipple and the child's palate. The nipple can have any ergonomic shape, for example it can flare on the sides of its top portion so as to co-operate effectively with the side portions of the child's palate.

As mentioned above, the invention is for babies and young children. It is possible to provide various sizes of teat as a function of the size of the child's mouth.

By way of indication, a teat for use with a newborn baby should have a plate that is compatible with dental arches having a maximum width (as measured at the rear ends of the dental arch) of about 3 centimeters; under such circumstances, the spacing between the two rear ends of the vestibular screen 40, which are substantially in register with each other, should be slightly greater than that, since the two ends of the screen are on the outside of the rear ends of the dental arch.

Still for a newborn baby, the length of the dental arch (distance measured in the longitudinal direction of the mouth) is about two centimeters; the plate 10 can then be comparable in length or slightly longer.

Figure 9A:
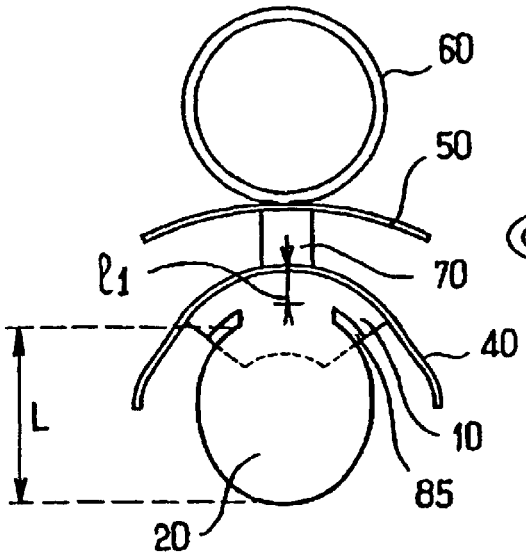
FIGS. 9*a* and 9*b* are respectively a plan view and a longitudinal section view of a pacifier of the invention for a child of less than three years of age.
Figure 9B:
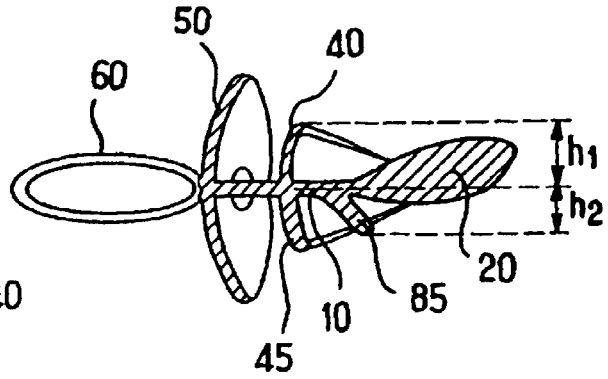

As shown in FIGS. 9*a* and 9*b*, which show a pacifier for a baby or a very young child, the plate 10 can also extend only in the front portion of the child's mouth, since the teeth situated towards the rear ends of the dental arches do not generally erupt before the age of three. Under such circumstances, the plate 10 extends over about 1.5 centimeters on either side of the middle axis of the teat (whereas the screen 40 can extend further back).

Figure 10A:
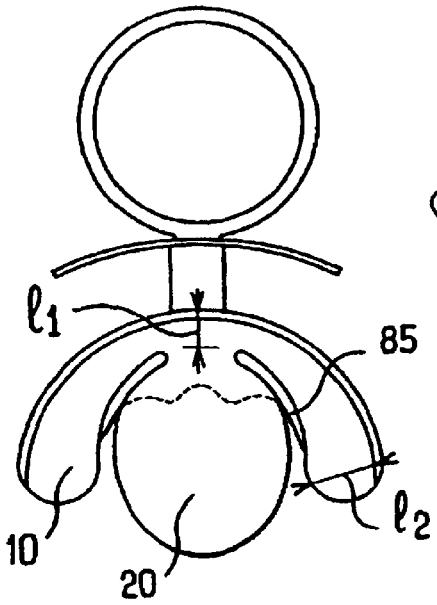
FIGS. 10*a* and 10*b* are two views corresponding to the views of FIGS. 9*a* and 9*b,* showing a pacifier of the invention for a child of more than three years of age.
Figure 10B:
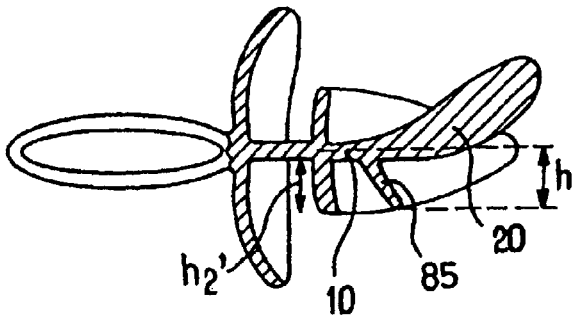

In general, the width of the plate 10 can be about 5 millimeters in the middle region of the plate (width l1), and if the plate extends towards the rear ends of the dental arches (in particular for children aged three or more, which corresponds to the device shown in FIGS. 10*a* and 10*b*), it can be about 8 millimeters towards the ends of the plate (width l2), so that the width of the plate corresponds to the width of the teeth or the dental arches.

Because of the offset δ between the screens 40 and 45, the width of the plate 10 which is about 5 millimeters in its middle region, is reduced on the bottom face of the plate, by a value corresponding to δ.

As mentioned above, pacifiers or teats of the invention can be made as a one-piece molding of a plastics material (such as rubber, silicone, . . . ). The thickness of the plate 10 which is of millimeter order is selected to be strong enough to withstand the action of the teeth and the dental arches and in particular to avoid being punctured in use, however the thickness must be as small as possible in order to avoid development of a gap between the dental arches.

As mentioned above, the nipple 20 must extend over the back of the child's tongue, so its length L can be about 2.5 centimeters, thereby extending rearwards in such a manner that its rear edge is about 3 centimeters behind the screen 40.

The nipple typically extends towards the rear of the teat so as to extend beyond the rear ends of the limbs of the U-shaped plate 10, such that with a teat intended for a child aged more than three (FIGS. 10*a* and 10*b*) said limbs can extend about 3 centimeters behind the vestibular screen 40, with the nipple projecting about 5 millimeters beyond the ends of the limbs.

The height h1 of the upper vestibular screen 40 can be about 8 millimeters, and that of the lower vestibular screen 45 can be about 5 millimeters for a child aged less than three (height h2 in FIG. 9*b*) and about 8 millimeters for an older child (height h2' in FIG. 10*b*).

FIGS. 9*a* to 10*b* show that the pacifier comprises not only vestibular screens 40 and 45 which extend from the front of the plate 10, but also a screen 85 which extends from the rear edge of the plate 10 at an oblique orientation both downwards and rearwards, so as to form an angle of about 45° with the plane of the plate 10.

The height h of such a screen 45 (i.e. its maximum extent in a longitudinal section plane of the teat) can be about 6 millimeters.

The nipple can be substantially round in shape when seen from above, so as to fill the child's mouth in the same manner as a breast during feeding. In FIGS. 9*a* and 10*a*, the nipple is thus generally in the form of a circle having a diameter of about 2.5 centimeters.

This nipple need not extend in line with the plane of the plate 10, but can extend upwards at an angle of bout 30° relative to said plane so that the nipple at rest extends rearwards over a length of about 2.5 centimeters and upwards over a height of about 1.5 centimeters.

What is claimed is:

1. A teat for a baby or a child, the teat comprising a plate on which the dental arches rest and defining a bite plane, said plate being terminated towards the front by a vestibular screen against which at least one of the dental arches comes into abutment in a desired position, and said plate being shaped to have limbs extending along at least a portion of the dental arches, said plate being secured to means projecting forwards out from the mouth, the teat further having a nipple projecting from the rear of the plate and connected thereto by elastic means, enabling the nipple to move away from the vestibular screen while then applying a return force to the nipple urging it towards the vestibular screen, said nipple extending rearwards beyond the ends of the limbs of said plate, said nipple being in register with the back portion of the tongue when the teat is in operation in the mouth of the baby or child so as to co-operate with the tongue and the palate and stimulate movement analogous to that of suckling, so that the teat performs simultaneously the functions of providing proper relative positioning of the dental arches in the mouth of the baby or child, by means of the configuration of the plate and of the vestibular screen, and of stimulating the tongue and a dynamic functioning of the stomatognathic system.

2. A teat according to claim 1, characterized in that the vestibular screen comprises:

a top portion situated above the bite plane; and a bottom portion situated below the bite plane and offset rearwards relative to the top portion.

3. A teat according to claim 2, characterized in that the offset between the top and bottom portions of the vestibular screen is about 1 mm to 3 mm.

4. A teat according to claim 3, characterized in that the means projecting forwards out from the mouth comprise an element for closing a baby's bottle, and the teat has a channel passing longitudinally there through to enable a baby or a child to suck a liquid contained in the bottle.

5. A teat according to claim 2, characterized in that the means projecting forwards out from the mouth comprise an element for closing a baby's bottle, and the teat has a channel passing longitudinally there through to enable a baby or a child to suck a liquid contained in the bottle.

6. A teat according to claim 1, characterized in that a substantially vertical wall is integrally formed with the rear edge of the plate and co-operates with the vestibular screen to define an aligner for receiving the dental arches.

7. A teat according to claim 6, characterized in that the means projecting forwards out from the mouth comprise an element for closing a baby's bottle, and the teat has a channel passing longitudinally there through to enable a baby or a child to suck a liquid contained in the bottle.

8. A teat according to claim 1, characterized in that said plate is generally U-shaped, with limbs extending rearwards to the rear ends of the dental arches.

9. A teat according to claim 8, characterized in that the means projecting forwards out from the mouth comprise an element for closing a baby's bottle, and the teat has a channel passing longitudinally there through to enable a baby or a child to suck a liquid contained in the bottle.

10. A teat according to claim 1, characterized in that the plate, the vestibular screen, and the nipple are integrally molded.

11. A teat according to claim 10, characterized in that the surface of the plate includes abrasive means.

12. A teat according to claim 11, characterized in that the means projecting forwards out from the mouth comprise a shield for pressing against the front faces of the lips or a handle ring.

13. A teat according to claim 12, characterized in that the means projecting forwards out from the mouth comprise an element for closing a baby's bottle, and the teat has a channel passing longitudinally there through to enable a baby or a child to suck a liquid contained in the bottle.

14. A teat according to claim 11, characterized in that the means projecting forwards out from the mouth comprise an element for closing a baby's bottle, and the teat has a channel passing longitudinally there through to enable a baby or a child to suck a liquid contained in the bottle.

15. A teat according to claim 10, characterized in that the means projecting forwards out from the mouth comprise an element for closing a baby's bottle, and the teat has a channel passing longitudinally there through to enable a baby or a child to suck a liquid contained in the bottle.

16. A teat according to claim 1, characterized in that the means projecting forwards out from the mouth comprise an element for closing a baby's bottle, and the teat has a channel passing longitudinally therethrough to enable a baby or a child to suck a liquid contained in the bottle.

* * * * *